United States Patent [19]

Prinz et al.

[11] 3,973,132

[45] Aug. 3, 1976

[54] APPARATUS FOR THE TREATMENT OF NON-CONDUCTIVE FOILS OR LIKE THIN SHEETING

[75] Inventors: Eckhard Prinz, Rotenbek; Wolfgang Henneberg, Norderstedt, both of Germany

[73] Assignee: Softal Elektronik GmbH, Hamburg, Germany

[22] Filed: Apr. 14, 1975

[21] Appl. No.: 567,501

[30] Foreign Application Priority Data

Apr. 27, 1974 Germany ..... 149658[U]

[52] U.S. Cl. ..... 250/531; 204/164; 204/165; 204/168; 250/325

[51] Int. Cl.[2] ..... B01K 1/00; H01T 19/04

[58] Field of Search ..... 204/164, 165, 168; 250/531, 325

[56] References Cited

UNITED STATES PATENTS

| | | | |
|---|---|---|---|
| 1,128,747 | 2/1915 | Boehm | 106/46 |
| 1,818,073 | 8/1931 | Long | 204/161 |
| 2,969,463 | 1/1961 | McDonald | 250/49.5 |
| 3,061,458 | 10/1962 | Arquette et al. | 117/62 |
| 3,294,971 | 12/1966 | Von der Heide | 250/531 X |
| 3,318,790 | 5/1967 | Carbajal et al. | 204/168 |
| 3,385,966 | 5/1968 | Rosenthal | 250/325 |
| 3,405,052 | 10/1968 | Schirmer | 250/531 |
| 3,435,190 | 3/1969 | Schirmer | 219/384 |
| 3,451,871 | 6/1969 | Bauer et al. | 156/244 |
| 3,483,374 | 12/1969 | Erben | 250/49.5 |
| 3,491,009 | 1/1970 | Ramaika | 204/165 |
| 3,503,859 | 3/1970 | Goncarovs et al. | 204/165 |
| 3,507,763 | 4/1970 | McBride | 250/531 X |
| 3,531,314 | 9/1970 | Kerr et al. | 250/531 X |
| 3,632,299 | 1/1972 | Thorsen | 8/128 |
| 3,668,097 | 6/1972 | Elsby | 204/165 |
| 3,669,720 | 6/1972 | Remer | 17/93.31 |
| 3,708,733 | 1/1973 | Bille | 317/262 A |
| 3,730,863 | 5/1973 | Keller | 204/164 |
| 3,740,325 | 6/1973 | Manion et al. | 204/169 |

FOREIGN PATENTS OR APPLICATIONS

| | | | |
|---|---|---|---|
| 2,014,646 | 3/1972 | Germany | |
| 802,254 | 10/1958 | United Kingdom | |
| 715,914 | 9/1954 | United Kingdom | |
| 933,577 | 8/1963 | United Kingdom | |
| 1,182,704 | 3/1970 | United Kingdom | 250/531 |
| 1,212,620 | 11/1970 | United Kingdom | 250/531 |

OTHER PUBLICATIONS

J. C. Von der Heide et al., "Guide to Corona Film Treatment," *Plastics Engineering*, May 1961, pp. 199ff.

W. A. Koehler, "Principles & Applications of Electrochemistry," vol. II, Second Edition, Wiley, N.Y., (1944), pp. 497–502.

*Primary Examiner*—John H. Mack
*Assistant Examiner*—Aaron Weisstuch
*Attorney, Agent, or Firm*—H. Dale Palmatier; James R. Haller

[57] ABSTRACT

Apparatus for the treatment of non-conductive foils or the like by subjecting them to a corona discharge of the type including two elongated electrodes with a gap between them and means for passing the foil or other sheeting through the gap has one of its electrodes, which is preferably the positive electrode, in the form of a profiled roller. The profile of the electrode roller comprises a series of ridges with troughs between them extending along the length of the roller parallel to its axis. The second electrode is also preferably in the form of a roller which has a smooth surface and is coated with dielectric material.

7 Claims, 5 Drawing Figures

1
4a 4b
1
4b

APPARATUS FOR THE TREATMENT OF NON-CONDUCTIVE FOILS OR LIKE THIN SHEETING

This invention relates to apparatus for the treatment of non-conductive foils and like thin sheets by means of a corona discharge in which the foil is passed between two electrodes, one of which, and preferably the positive, is a roller electrode.

During the treatment of non-conductive materials, such as synthetic foils and paper, a corona discharge is produced by an electrical apparatus which is so connected that one electrode is at a high potential and the other, which is parallel to the first, is earthed.

For this purpose various types of electrodes are already known, for instance they may be knife-like, but electrodes in the form of a U-profile, a screw-threaded rod, spring or a wire can also be used. In addition, the electrodes may be roller-shaped and may either be self-driven or externally driven. The counter-electrode is normally coated with a dielectric material and is roller-shaped, thus also serving as a lead-in for the foil.

The effect of the treatment is better when knife-shaped electrodes are used than when roller electrodes are used. The intensity of the treatment is measured as an increase in the surface stress. The reason for the better results achieved with knife-shaped electrodes is that the electrostatic field strength is greater due to the relatively small radius of curvature of the knife edges. The larger radius of curvature of roller electrodes results in the field being more diffused which in turn leads to a less effective treatment.

However knife-shaped electrodes do have mechanical disadvantages. They are not structurally very rigid and must therefore be mounted on a suitable support. It is furthermore difficult when longer electrodes are used (in the region of 1 meter or more), to set and maintain the optimal electrode gap over the whole length of the electrodes. The heat generated by the electrical discharge causes expansion of the electrodes which results in bending or distortion so that the electrode gap may vary considerably along the length of the electrodes. This leads to variations in the intensity of the treatment over the area of the foil since this depends on the electrode gap.

Roller electrodes are much more rigid. They have the additional advantage that they need only be mounted at their ends. They are therefore preferably used for thicker foils which are made of strong materials and are moved at high speeds. They also enable the machine to be constructed so that a "flying splice" may be carried out on it. In such s splice two successive strips of foil are formed together in an overlapping relationship while the machine is running at full speed. The double thickness of foil at the join must be able to pass undamaged through the electrode gap. This can easily be done when using roller electrodes. When using knife-shaped electrodes there is the danger that one of the edges of the foil at the join will catch on a knife blade resulting in a bending or breaking of the knife blade or tearing of the foil. Therefore in practice the mechanical advantages of roller electrodes contrast with the disadvantage of reduced intensity of treatment.

It is the aim of this invention to provide an apparatus for the treatment of a non-conductive foil or like thin sheet by subjecting it to a corona discharge including two elongated electrodes with a gap between them and means for passing the foil or other sheet through the gap, and the apparatus combining some at least of the advantages of both knife-shaped electrodes and roller electrodes.

To this end, according to this invention, in such apparatus one of the electrodes is in the form of a profiled roller, the profile comprising a series of ridges with troughs between them extending along the length of the electrode parallel to its axis.

The use of a profiled roller electrode makes it possible, with the use of a normal counter electrode, to attain a much better intensity of treatment, while maintaining the mechanical advantages, because the corona discharge is emitted from the raised sections onto the counter electrode. The ridges function in the same fashion as the edges of the known knife-shaped electrode.

A preferred example and some modifications of an apparatus in accordance with the invention will now be described with reference to the accompanying drawings, in which.

Figure 1:
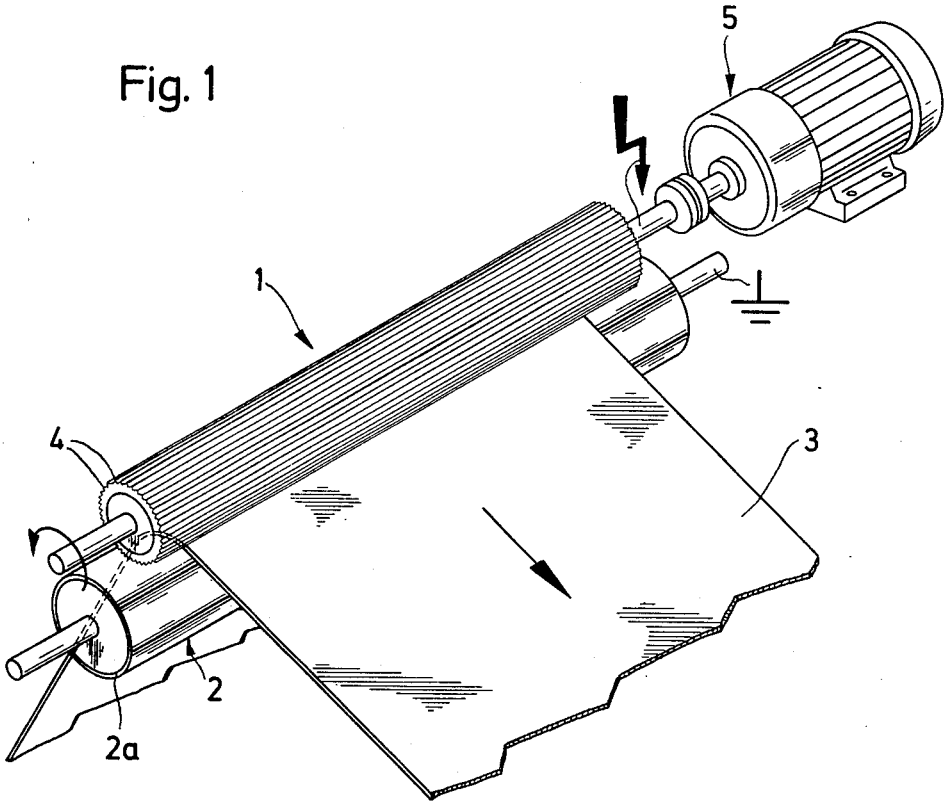
FIG. 1 is a highly diagrammatic perspective view of the electrodes of the apparatus.
Figure 2:
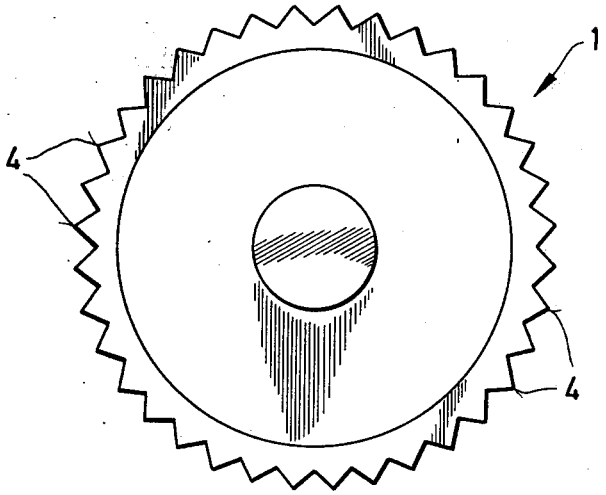
FIG. 2 is a diagrammatic side view of one of the electrodes.

The apparatus shown in FIGS. 1 and 2 of the drawings includes a counter-electrode 2 in the form of a smooth roller coated with a dielectric material 2*a*, and a profiled, power-driven (motor 5) roller electrode 1. A foil or strip 3 being treated is passed through a nip or gap between the two rollers.

As may be seen from FIG. 2, the profiled electrode 1 has a fluted surface forming a series of axially extending ridges 4 with troughs between them. The fluting can be profiled in a wide variety of ways so that the height, separation and shape of the ridges may all vary. It is not necessary that the fluting cover the whole axial length of the roller. It can either cover only a portion of the length of the roller or be in several axially spaced sections.

Figure 3:
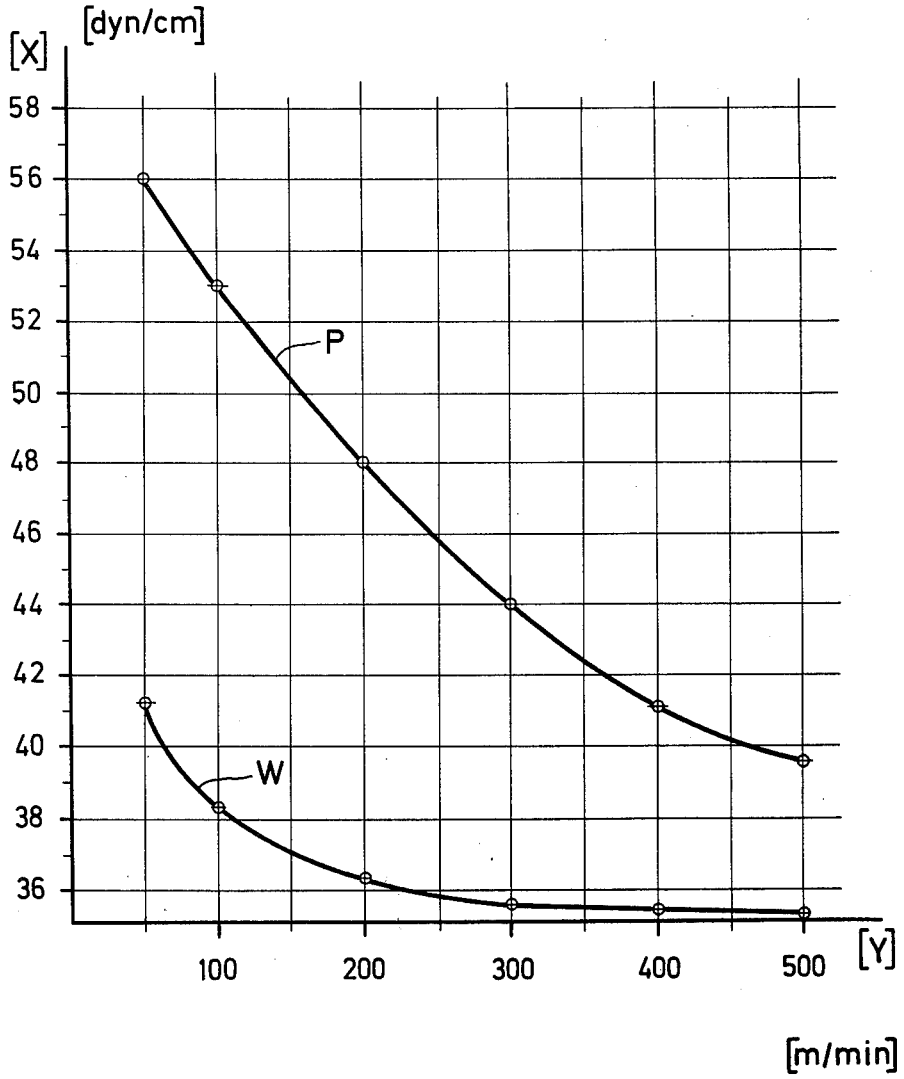
FIG. 3 is a graph illustrating the intensity of the treatment.

FIG. 3 clearly shows the improved intensity of treatment achieved with the profiled roller electrode as shown by the upper curve P compared with that achieved with a smooth-surfaced roller electrode as shown by the lower curve W under otherwise similar treatment conditions.

The graph shows the speed of the foil in meters/min. plotted along the horizontal axis and the surface stressing of the foil, which is produced by the treatment, in dynes/cm. plotted along the vertical axis.

Figures 4, 4A, 4B:
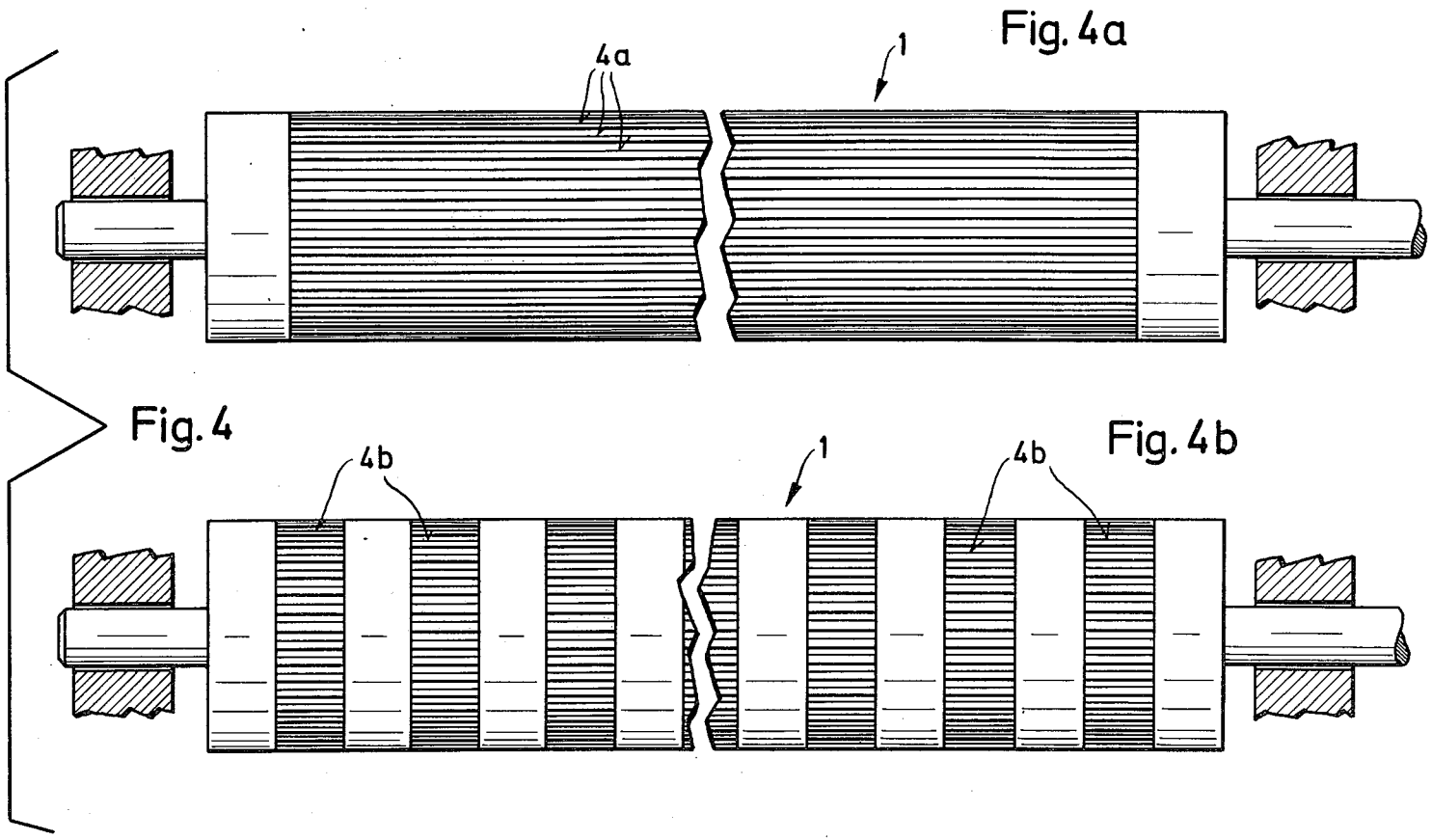
FIG. 4 is a diagrammatic front view of two further forms of electrode.

As already mentioned it is not essential that the fluting extend along the whole length of the roller. The ridges or crests can be shorter and/or interrupted so that the foil is pre-treated over certain predetermined portions of its width. FIG. 4, which is a diagrammatic front view of two modifications of the profiled roller electrode, shows, in FIG. 4*a*, fluting that does not extend to the end of the roller and, in FIG. 4*b*, longitudinally interrupted fluting.

We claim:

1. In apparatus for the treatment of non-conductive foils and like thin sheeting by subjecting said sheeting to a corona discharge, said apparatus including first and second elongated electrodes, means supporting said electrodes to define a gap between said electrodes and means for passing said sheeting through said gap, the second electrode having a smooth, foil-engaging surface, the improvement wherein said first electrode is in the form of a revolving profiled roller, said roller having a profile comprising a series of ridges and troughs between said ridges, said ridges and said troughs extending along the length of said roller parallel to the axis thereof.

2. Apparatus as claimed in claim 1, wherein said first electrode is adapted to be a positive electrode and further comprising means earthing said second electrode.

3. Apparatus as claimed in claim 2, wherein said second electrode is in the form of a second smooth surfaced roller and further comprising dielectric material coating the peripheral surface of said second roller, said second roller acting as a lead-in for said sheeting.

4. Apparatus as claimed in claim 3, wherein said second roller has a smooth peripheral surface.

5. Apparatus as claimed in claim 1, further comprising power means for rotating said first electrode.

6. Apparatus as claimed in claim 1, wherein said ridges and said troughs extend over only a part of said length of said first electrode, the remainder of said length of said first electrode being smooth-surfaced.

7. Apparatus as claimed in claim 6, wherein said ridges and said troughs extend over two portions of said length of said first electrode with an interruption of said ridges and said troughs between said portions.

* * * * *